US009091047B2

(12) United States Patent
Aldrich

(10) Patent No.: US 9,091,047 B2
(45) **Date of Patent: *Jul. 28, 2015**

(54) SINK-SUPPORT ASSEMBLY FOR PROVIDING A WATERPROOF SINK INSTALLATION AND METHOD OF PROVIDING A WATERPROOF SINK INSTALLATION

(71) Applicant: Aldrich Fabrication Center, Inc., St. Johnsbury, VT (US)

(72) Inventor: Gregory J. Aldrich, Waterford, VT (US)

(73) Assignee: Aldrich Fabrication Center, Inc., St. Johnsbury, VT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/556,957

(22) Filed: Dec. 1, 2014

(65) Prior Publication Data

US 2015/0082536 A1 Mar. 26, 2015

Related U.S. Application Data

(63) Continuation of application No. 11/078,754, filed on Mar. 11, 2005, now Pat. No. 8,898,827.

(60) Provisional application No. 60/607,647, filed on Sep. 7, 2004.

(51) Int. Cl.
*E03C 1/33* (2006.01)

(52) U.S. Cl.
CPC ..... *E03C 1/33* (2013.01)

(58) Field of Classification Search
CPC ..... E03C 1/33
USPC ..... 4/631–632, 635, 660
See application file for complete search history.

(56) References Cited

U.S. PATENT DOCUMENTS

| | | | |
|---|---|---|---|
| 1,827,053 | A | 10/1931 | Veneman |
| 2,397,690 | A | 4/1946 | Pawlus et al. |
| 2,475,112 | A | 7/1949 | Stanitz |
| 2,480,792 | A | 8/1949 | Bommel |

(Continued)

FOREIGN PATENT DOCUMENTS

| | | | |
|---|---|---|---|
| EP | 0442189 | A1 | 2/1990 |
| EP | 503895 | A2 | 9/1992 |
| GB | 2224648 | A | 5/1990 |

OTHER PUBLICATIONS

Restriction Requirement dated Jun. 6, 2007, in parent U.S. Appl. No. 11/078,754, filed Mar. 11, 2005.

(Continued)

*Primary Examiner* — Lori Baker
(74) *Attorney, Agent, or Firm* — Downs Rachlin Martin PLLC

(57) ABSTRACT

A waterproof sink insert for installing an under-mount sink in a built-up surround having a non-waterproof support structure so as to inhibit water damage to the support structure. The sink support insert is mounted within an insert opening formed in the support structure. The sink support insert comprises a mounting region located radially inward from the outer periphery of the sink support insert. The sink is secured to the sink support structure within the mounting region. The sink support insert may optionally include one or more apertures for receiving a faucet or other sink appurtenance(s).

20 Claims, 4 Drawing Sheets

(56) References Cited

U.S. PATENT DOCUMENTS

| | | | |
|---|---|---|---|
| 2,505,828 | A | 5/1950 | Fox |
| 2,600,599 | A | 6/1952 | Wycoff |
| 2,628,365 | A | 2/1953 | Drain |
| 3,229,310 | A | 1/1966 | Ensch |
| 3,982,287 | A | 9/1976 | Miller |
| 4,374,695 | A | 2/1983 | Ikeda et al. |
| 5,551,103 | A | 9/1996 | Drozdowich et al. |
| 5,754,991 | A | 5/1998 | Drozdowich et al. |
| 6,108,831 | A | 8/2000 | Lombreglia, Jr. |
| 6,349,429 | B1 | 2/2002 | Zurba et al. |
| 6,530,097 | B1 | 3/2003 | Sung |
| 2006/0048295 | A1 | 3/2006 | Aldrich |

OTHER PUBLICATIONS

Response to Restriction Requirement dated Jun. 14, 2007, in parent U.S. Appl. No. 11/078,754, filed Mar. 11, 2005.

Office Action dated Jul. 17, 2007, in parent U.S. Appl. No. 11/078,754, filed Mar. 11, 2005.

Amendment and Response to Office Action dated Dec. 17, 2007, in parent U.S. Appl. No. 11/078,754, filed Mar. 11, 2005.

Final Office Action dated Feb. 11, 2008, in parent U.S. Appl. No. 11/078,754, filed Mar. 11, 2005.

Amendment and Response to Final Office Action dated Aug. 8, 2008, in parent U.S. Appl. No. 11/078,754, filed Mar. 11, 2005.

Request for Continued Examination dated Aug. 8, 2008, in parent U.S. Appl. No. 11/078,754, filed Mar. 11, 2005.

Office Action dated Sep. 8, 2008, in parent U.S. Appl. No. 11/078,754, filed Mar. 11, 2005.

Amendment and Response to Office Action dated Jan. 7, 2008, in parent U.S. Appl. No. 11/078,754, filed Mar. 11, 2005.

Final Office Action dated Feb. 27, 2009, in parent U.S. Appl. No. 11/078,754, filed Mar. 11, 2005.

Amendment and Response to Final Office Action Following First RCE dated May 27, 2009, in parent U.S. Appl. No. 11/078,754, filed Mar. 11, 2005.

Request for Continued Examination dated Jun. 29, 2009, in parent U.S. Appl. No. 11/078,754, filed Mar. 11, 2005.

Office Action dated Sep. 2, 2009, in parent U.S. Appl. No. 11/078,754, filed Mar. 11, 2005.

Amendment and Response to Office Action dated Dec. 2, 2009, in parent U.S. Appl. No. 11/078,754, filed Mar. 11, 2005.

Final Office Action dated Feb. 9, 2010, in parent U.S. Appl. No. 11/078,754, filed Mar. 11, 2005.

Notice of Appeal dated Jun. 9, 2010, in parent U.S. Appl. No. 11/078,754, filed Mar. 11, 2005.

Appeal Brief dated Sep. 9, 2010, in parent U.S. Appl. No. 11/078,754, filed Mar. 11, 2005.

Examiners Answer to Appeal Brief dated Oct. 25, 2010, in parent U.S. Appl. No. 11/078,754, filed Mar. 11, 2005.

Reply Brief dated Dec. 22, 2010, in parent U.S. Appl. No. 11/078,754, filed Mar. 11, 2005.

Decision on Appeal dated Jan. 11, 2011, in parent U.S. Appl. No. 11/078,754, filed Mar. 11, 2005.

Decision on Appeal dated Jul. 1, 2013, in parent U.S. Appl. No. 11/078,754, filed Mar. 11, 2005.

Notice of Abandonment dated Sep. 20, 2013, in parent U.S. Appl. No. 11/078,754, filed Mar. 11, 2005.

Petition for Revival of Application for Patent Abandoned Unintentionally dated Feb. 14, 2014, in parent U.S. Appl. No. 11/078,754, filed Mar. 11, 2005.

Request for Continued Examination dated Feb. 14, 2014, in parent U.S. Appl. No. 11/078,754, filed Mar. 11, 2005.

Response After Final Office Action dated Feb. 14, 2014, in parent U.S. Appl. No. 11/078,754, filed Mar. 11, 2005.

Office Action dated Jun. 19, 2014, in parent U.S. Appl. No. 11/078,754, filed Mar. 11, 2005.

Amendment and Response to Office Action dated Sep. 19, 2014, in parent U.S. Appl. No. 11/078,754, filed Mar. 11, 2005.

Notice of Allowance dated Oct. 10, 2014, in parent U.S. Appl. No. 11/078,754, filed Mar. 11, 2005.

SINK-SUPPORT ASSEMBLY FOR PROVIDING A WATERPROOF SINK INSTALLATION AND METHOD OF PROVIDING A WATERPROOF SINK INSTALLATION

RELATED APPLICATION DATA

This application is a continuation of U.S. patent application Ser. No. 11/078,754, filed Mar. 11, 2005 and entitled "Sink Installation and Method of Installing a Sink," (which will issue as U.S. Pat. No. 8,898,827 on Dec. 2, 2014); and which claims the benefit of priority of U.S. Provisional Patent Application Ser. No. 60/607,647, filed Sep. 7, 2004, and titled "Sink Installation and Method of Installing a Sink." Each of these applications is incorporated by reference herein in its entirety.

FIELD OF THE INVENTION

The present invention generally relates to the field of building construction. In particular, the present invention is directed to a sink-support assembly for providing a waterproof sink installation and method of providing a waterproof sink installation.

BACKGROUND

Sinks for kitchens, bathrooms, lavatories and other facilities come in a vast array of designs and several styles. Examples of sink styles include top-mount, under-mount and integral. Countertops and other sink surrounds likewise come in a variety of designs and a few styles. The two primary styles of surrounds are built-up and monolithic. A built-up surround generally includes a substrate onto which a surfacing is applied. The substrate is typically made of wood or wood composite material, such as plywood, particle board or flake board, among others. The surfacing is often either a surface laminate, e.g., a Formica® laminate available from Formica Corporation, Cincinnati, Ohio and equivalents thereto, or tile-work. A monolithic surround, on the other hand, is one in which the full thickness of the countertop is made of a single, self-supporting material, such as natural stone, e.g., soapstone, granite, marble, etc., synthetic stone, wood and polymeric materials, e.g., Corian® solid surfacing material available from E.I. DuPont de Nemours, Inc., Wilmington, Del. and equivalents thereto, and more recently, concrete, among others.

Generally, a top-mounted sink is installed in a surround, e.g., countertop, or other support structure having an opening that receives the bowl of the sink. The sink includes a peripheral flange that engages an upper surface of the surround so that the bowl is supported in the opening. An under-mount sink, on the other hand, is supported from the underside of the surround. An under-mount sink may or may not have a flange and may be secured to the underside of a surround in any of a variety of ways, such as by adhesive bonding and/or mechanical fastening. An integral sink is generally a sink that is made of the same material as the surround and that is joined to, or formed with, the countertop so as to form a seamless unit. Integral sinks and surrounds were originally single castings or moldings but, with the relatively recent advent of polymeric solid-surface materials, are now often made by virtually seamlessly joining pre-shaped sinks to corresponding like-material solid-surface surrounds.

Top-mounted sinks can be used with virtually any type of surround. This is so generally because top-mounted sinks have the advantage that the interface between their support flange and the surround is located on the upper surface of the surround. Consequently, this interface may be readily sealed to inhibit water infiltration. This is particularly important in the case of built-up surrounds since most built-up countertops comprise a non-waterproof substrate, e.g., particle board, flake board, etc., that, when exposed to liquid water, tends to wick in the water, thereby expanding and losing its integrity and strength. However, top-mounted sinks have the drawback that the presence of the flange on top of the surround typically presents an obstacle to squeegeeing any water present on the upper surface of the surround into the sink. In addition, top-mounted sinks may not be as aesthetically pleasing as other styles of sinks, at least in the eyes of some people.

Under-mount sinks eliminate the need for a flange on the upper surface of the surround and can present an aesthetically attractive sink. As mentioned, an under-mounted sink is secured to the underside of a surround, which leaves at least the peripheral edge of the sink opening in the surround exposed to water from the sink and other environmental elements. Thus, this peripheral edge frequently gets wet. Consequently, under-mount sinks are most easily used with monolithic surrounds in which the full thickness of the surrounds is occupied by a waterproof material that does not have the wicking and associated problems that built-up surrounds made using non-waterproof substrates can have.

Unfortunately, monolithic surrounds are typically relatively expensive compared to built-up surrounds. Therefore, use of under-mount sinks has been expanded to built-up surrounds in order to make desirable under-mount sink installations more affordable. However, water infiltration problems can arise at the edge of the sink opening in the built-up surround. If the surfacing is applied just right, the edge will be watertight. However, it is difficult to make the peripheral edge completely watertight. Consequently, installations of under-mount sinks to built-up surrounds are prone to substrate damage at the edge of the sink opening. This is particularly true in the case of laminated surrounds.

Others in the industry have recognized and attempted to deal with the water damage problem that can arise from installing an under-mount sink on a built-up surround. One solution that has been implemented is disclosed in U.S. Pat. No. 5,551,103 to Drozdowich et al. This solution involves forming a relatively narrow ring from a waterproof solid-surfacing material and installing this ring in an oversize opening in a substrate that undergirds the surround. The ring and opening in the substrate are configured with complementary bevels that require the ring to be installed from the underside of the substrate. (Such bevels are referred to herein as "reverse bevels.") After the ring has been adhered into place, a sink is installed by securing the sink to the underside of the substrate, beyond the outer periphery of the ring. A surfacing material, such as a laminate or tile-work, is then installed on the upper surface of the substrate to finish the installation of the surround.

Although the Drozdowich et al. solution generally reduces the probability that the substrate will be damaged from water infiltrating from the region surrounding the sink opening in the ring, it has a number of drawbacks. For example, the ring is relatively narrow, such that there is relatively little overlap of the surfacing material with the ring. If the surfacing is not installed properly, water from the surface of the surround can reach the substrate. In addition, as mentioned, the ring must be installed from below the surround substrate due to the reverse bevels in the ring and substrate. This requires special installation techniques, such as clamping. Another drawback of the Drozdowich et al. solution is that the sink is secured to the substrate. Sometimes substrates used for surrounds have relatively low resistance to fastener pullout when compared to substrates made of other materials, such as a solid surfacing material. Yet another drawback of the Drozdowich et al. solution is that the sink must be installed after the ring. This may inconveniently constrain the number of ways an installer can choose to install such a sink or the ways in which sink installations can be componentized, e.g., for shipping or marketing purposes. Moreover, the peripheral edge of the sink opening is not the only location where water damage can occur. Water damage can also occur at the one or more openings where the faucet, hot and cold water supply lines, and/or other items, e.g., extendible sprayers, etc., extend through the countertop.

SUMMARY OF THE DISCLOSURE

In one implementation, the present disclosure is directed to a sink-support assembly for installing a sink having a weight into a countertop for providing a finished sink installation that includes a faucet. The sink-support assembly includes a sheet substrate made of a non-waterproof material, the sheet substrate comprising: a supportive inner periphery defining an insert opening; and a planar upper surface designed and configured to adhesively receive countertop surfacing in the finished sink installation; and a sink-support insert secured to the sheet substrate and designed and configured to carry the weight of the sink to the sheet substrate in the finished sink installation, the sink support insert comprising a plate made of a waterproof material, the plate: having a planar upper surface designed and configured for adhesively receiving countertop surfacing when the sink-support insert is in the finished sink installation; having a lower surface; having an outer periphery conformally engaging the supportive inner periphery of the sheet substrate so that in the finished sink installation: the supportive inner periphery vertically supports the sink-support insert and the sink and the faucet attached thereto in the finished sink installation; and the planar upper surface of the plate is flush with the planar upper surface of the sheet substrate; wherein the plate is sized and configured to receive a sink opening spaced from the outer periphery of the plate so as to define a sink mounting region and a spacing between the sink mounting region and the outer periphery of the plate that is: selected to provide a waterproof faucet mounting region sized and configured to receive a faucet aperture for receiving therethrough a portion of the faucet in the finished sink installation; and selected to decrease, in the finished sink installation, a likelihood of any water that infiltrates between the sink and the sink mounting region migrating to the sheet substrate along the lower surface of the plate.

In another implementation, the present disclosure is directed to a method of fabricating a sink-support assembly for installing into a finished sink installation comprising a sink and countertop surfacing, wherein the sink has a weight. The method includes providing a sheet of waterproof material having a first planar upper surface for receiving the countertop surfacing in the finished sink installation; fabricating a sink-support insert from the sheet of waterproof material, wherein the fabricating the sink-support insert includes: sizing the sink-support insert to accommodate a sink opening that defines a sink mounting region and a spacing between the sink mounting region and an outer periphery of the sink-support insert that is: selected to provide a waterproof faucet mounting region sized and configured to receive a faucet aperture for receiving therethrough a portion of the faucet in the finished sink installation; and selected to decrease, in the finished sink installation, a likelihood of any water that infiltrates between the sink and the sink mounting region migrating to the outer periphery along the lower surface of the plate; providing a sheet of non-waterproof material having a second planar upper surface for receiving the countertop surfacing in the finished sink installation; fabricating a sheet substrate from the sheet of non-waterproof material, wherein the fabricating the sheet substrate includes: forming an insert opening in the sheet substrate; and providing the sheet substrate with a supportive inner periphery at the insert opening, wherein the supportive inner periphery is configured to: provide vertical support against gravity to the sink support insert for transferring the weight of the sink to the sheet substrate in the finished sink installation; and engage the outer periphery of the sink-support insert so that the first planar upper surface is flush with the second planar upper surface; and securing the sink support insert to the sheet substrate in the insert opening so that the first planar upper surface is flush with the second planar upper surface.

BRIEF DESCRIPTION OF THE DRAWINGS

For the purpose of illustrating the invention, the drawings show a form of the invention that is presently preferred. However, it should be understood that the present invention is not limited to the precise arrangements and instrumentalities shown in the drawings, wherein.

DETAILED DESCRIPTION

Figure 1A:
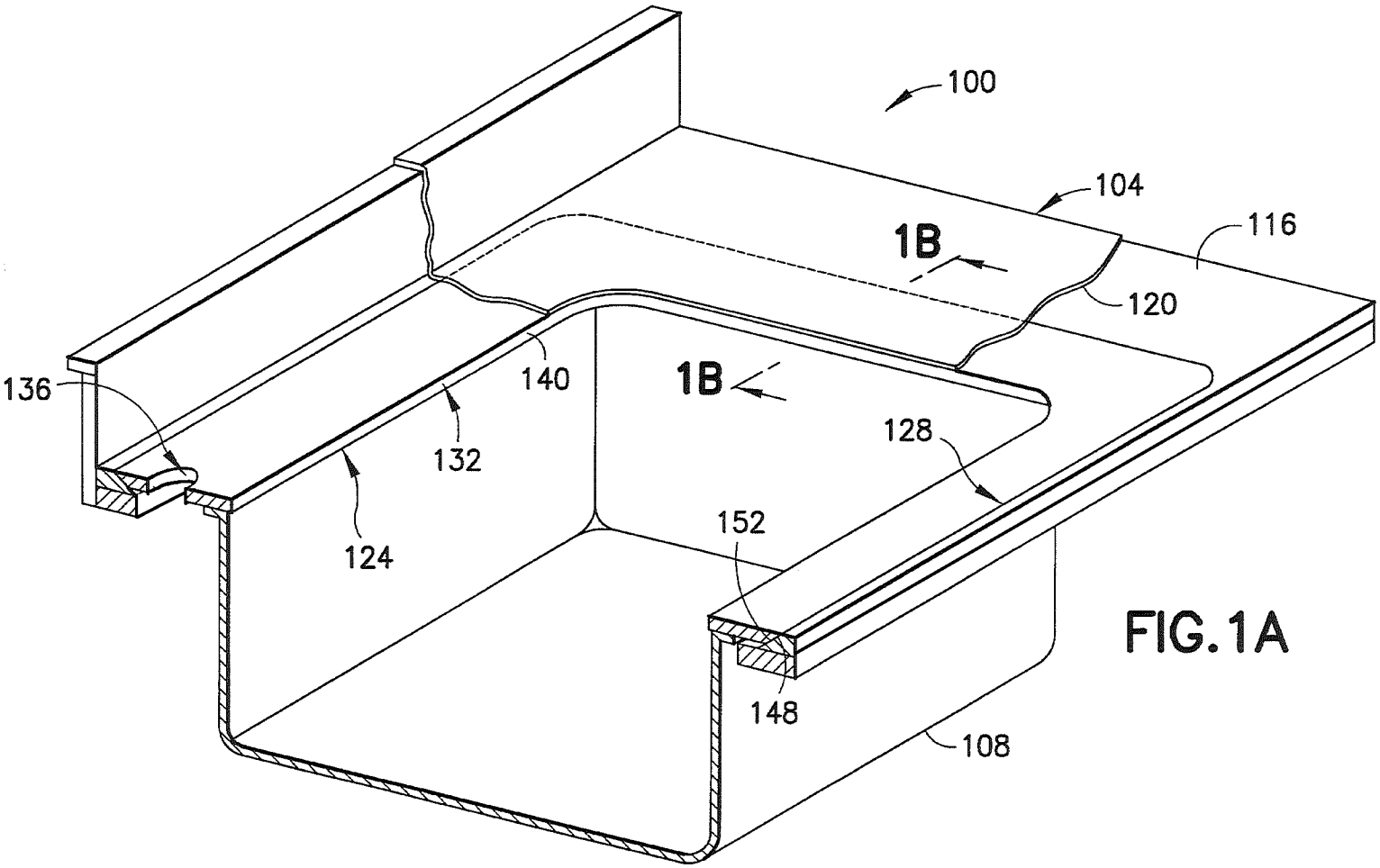
FIG. 1A is a partial perspective, partial cross-sectional view of a sink installation of the present invention.

FIG. 1A shows in accordance with the present invention a sink installation, which is generally indicated by the numeral 100. Sink installation 100 may include a surround 104, such as a countertop, a sink 108 secured to the underside of the surround and a faucet system (not shown) for use in conjunction with the sink. Surround 104 may be a built-up surround comprising a support structure 116 and surfacing 120 secured to the support structure in any conventional manner. Support structure 116 may be made of any suitable material, such as wood, a wood composite, e.g., particle board or flake board, among others, or a non-wood-containing material. In addition, support structure 116 may take any of a variety of forms, such as the plate form shown in which the support structure is made from one or more sheets of common building component, such as plywood, particle board or chip board, among others. Another example of a form of support structure 116 is a frame (not shown) made of, e.g., common "two-by-fours" or other lumber, or metal or other structural members. Surfacing 120 may be any suitable surfacing, such as a laminate, e.g., a Formica® laminate, or equivalent thereto, or tile-work, among others. Those skilled in the art are readily familiar with the various types of support structures 116 and surfacing 120 that may be used. Therefore, exhaustive lists and discussions of each is not necessary for those skilled in the art to understand the broad scope of the present invention.

Figure 2:
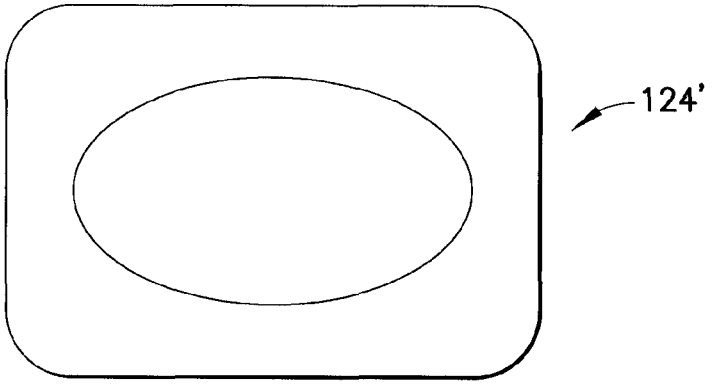
FIG. 2 is a reduced plan view of a sink support insert of the present invention that does not include apertures for sink appurtenances.

Surround 104 also includes a sink support insert 124 that engages an insert opening 128 in support structure 116. Sink support insert 124 is typically in the form of a plate and may include a sink opening 132 for creating access to sink 108 from above and one or more openings 136 for allowing one or more components, e.g., valves, water supply lines, a mixed water line, an extendable sprayer, etc., of the faucet system and/or one or more other sink appurtenances, e.g., an integrated soap dispenser, to pass through the surround 104. In alternative embodiments, as illustrated in FIG. 2, a sink support insert 124' of the present invention need not include appurtenance openings. In this case, any openings required for a faucet system and other sink appurtenances may be located in the support structure, as in many conventional installations.

Referring again to FIG. 1A, as discussed in the background section above, water infiltration at the periphery of a sink opening (corresponding to sink opening 132) and/or at the periphery of each appurtenance opening (corresponding to each opening 136) in a conventional sink installation (not shown) can lead to degradation of a conventional support structure (not shown), particularly if the conventional support structure is made of a non-waterproof material. Consequently, sink support insert 124 should be waterproof, i.e., not materially damaged by water within the normal lifetime of a conventional like sink installation in which water damage is not present. While sink support insert 124 may be made of virtually any one or more materials, including a non-waterproof material coated, or otherwise covered, with a waterproof material that makes the insert waterproof in the context of the present invention, the insert may be readily made using a solid-surfacing material, e.g., a Corian®, or similar, material. This is so because such solid-surfacing materials are easy to shape, cut, drill, etc. using conventional tools and are proven in terms of stability and fastening techniques. For example, openings 132, 136 may be made in a solid surfacing material using the same techniques used to make such openings in a conventional support structure. In the context of solid-surfacing materials, it can be readily appreciated that the plate nature of sink support insert 124 derives from the sheets in which solid-surfacing material is commonly sold.

In the embodiment shown, sink 108 is an under-mount sink that is fastened to the underside of sink support insert 124 within a mounting region 144 (FIG. 1C) that is preferably spaced from the outer periphery 148 of the sink support insert. Providing such spacing between mounting region 144 (FIG. 1C) and outer periphery 148 can provide a number of advantages. For example, the larger this spacing, the farther the support structure is from sink opening 132 where water is often most likely to infiltrate between surfacing and sink support insert 124. In addition, in installations in which sink 108 is mounted to sink support insert 124 prior to the sink support insert being installed in insert opening 128, a larger spacing can make the assembly easier to handle and install. Furthermore, a relatively large spacing provides space for apertures 136, when provided.

Sink 108 may be fastened to sink support insert 124 in any conventional manner, such as by adhesive bonding, mechanical fastening and/or using clips, among others. In addition, it is noted that sink 108 does not need to be an under-mount sink. Rather, sink 108 can be a top-mount sink. For example, if surfacing 120 is tile-work, sink 108 may be what is often referred to as a "tiled-in" sink. Generally, a tiled-in sink is a top-mount sink having a flange (which serves as the mounting region of the sink) supported by a conventional support structure (not shown), or in the present invention, by sink support insert 124. After the top-mount sink has been installed, tile-work (which is a form of surfacing 120) is then applied to support structure 116 up to the flange of the sink. In this scenario, in the event that the tile-work fails to provide a watertight seal at or adjacent the interface between the tile-work and the flange, water can infiltrate and damage the support structure beneath the flange.

Figure 1B:
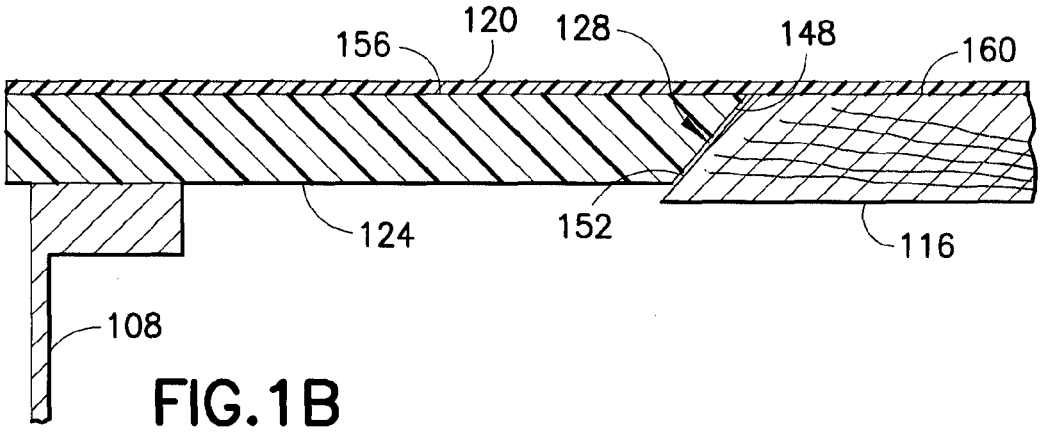
FIG. 1B is an enlarged cross-sectional view of the sink installation of FIG. 1A as taken along line 1B-1B of FIG. 1A showing the interface between the sink support insert and the support structure.
Figure 1C:
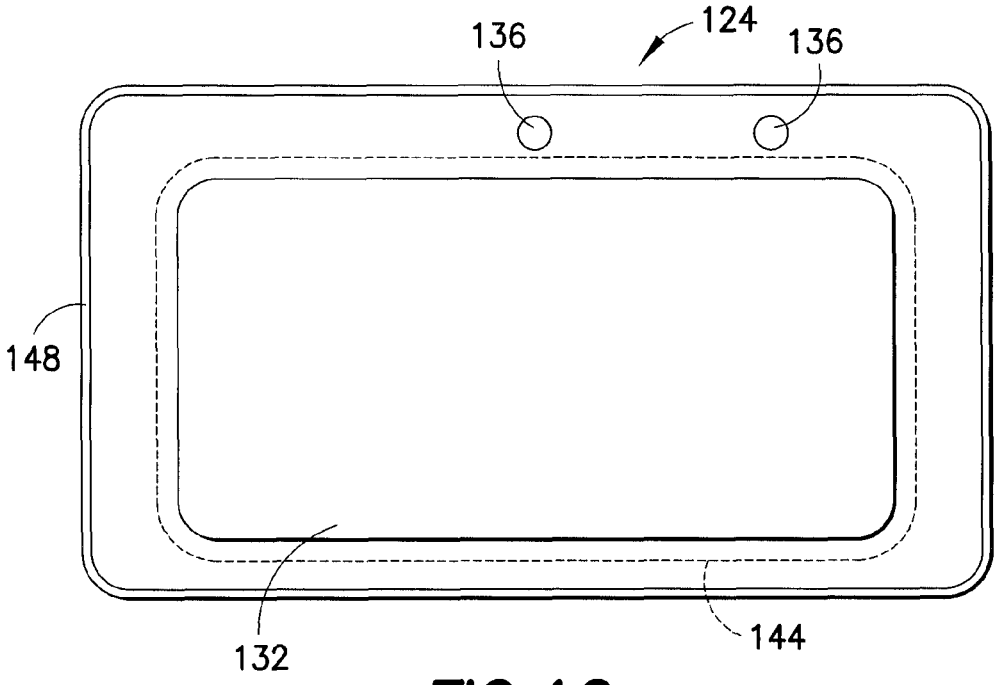
FIG. 1C is a reduced view of the underside of the sink support insert of FIG. 1A.

Sink support insert 124 may be supported by support structure 116 in any of a variety of ways. For example and referring particularly to FIG. 1B, a desirable way of supporting sink support insert 124 is to shape the outer periphery 148 of the insert and the inner periphery 152 of support structure 116 in a complementary manner and such that the inner periphery of the support structure supports the insert. For example, FIG. 1B shows peripheries 148, 152 as having complementary "forward" bevels (as opposed to the reverse bevels discussed relative to the Drozdowich et al. solution in the Background section above) configured so that when sink support insert 124 is installed into insert opening 128, the upper surface 156 of the insert is flush with the upper surface 160 of the support structure. This typically makes the installation of surfacing 120 straightforward. Sink support insert 124 may be secured to support structure 116 in any suitable manner, such as adhesive bonding, mechanical fastening or using retaining clips, among others. The forward bevels of peripheries 148, 152 have the benefit that essentially only gravity need be exploited to hold sink support insert 124 in place during fastening. Particularly if sink 108 is mounted to sink support insert 124 prior to installing the insert, additional weight applied to the insert may not be necessary during fastening to aid in fastening, even when forming an adhesive joint.

Figure 3A:
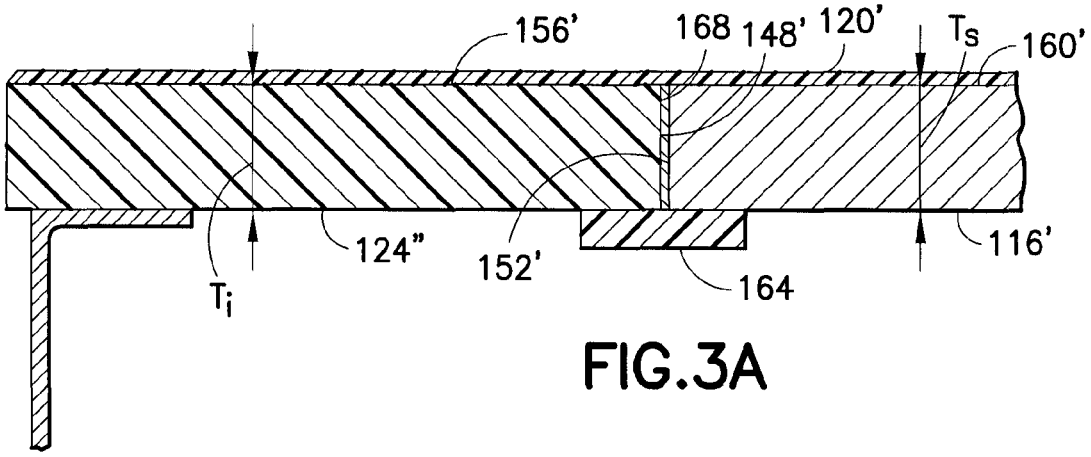
FIGS. 3A-3C are each a cross-sectional view of an alternative interface between the sink support insert and the support structure.
Figure 3B:
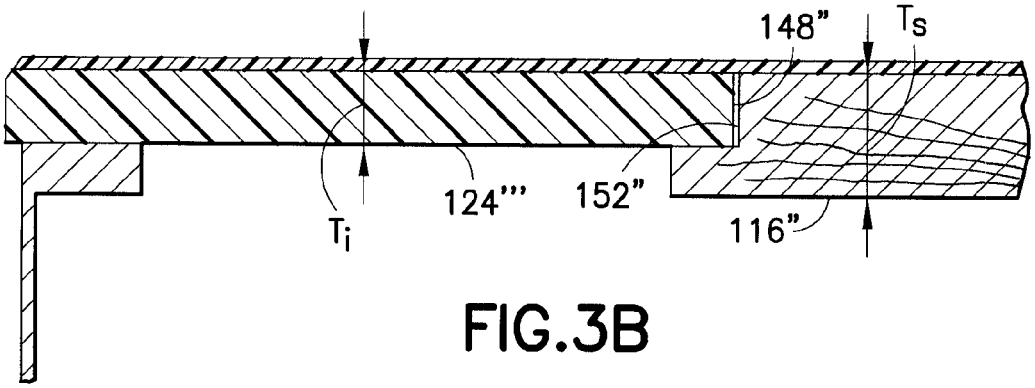
Figure 3C:
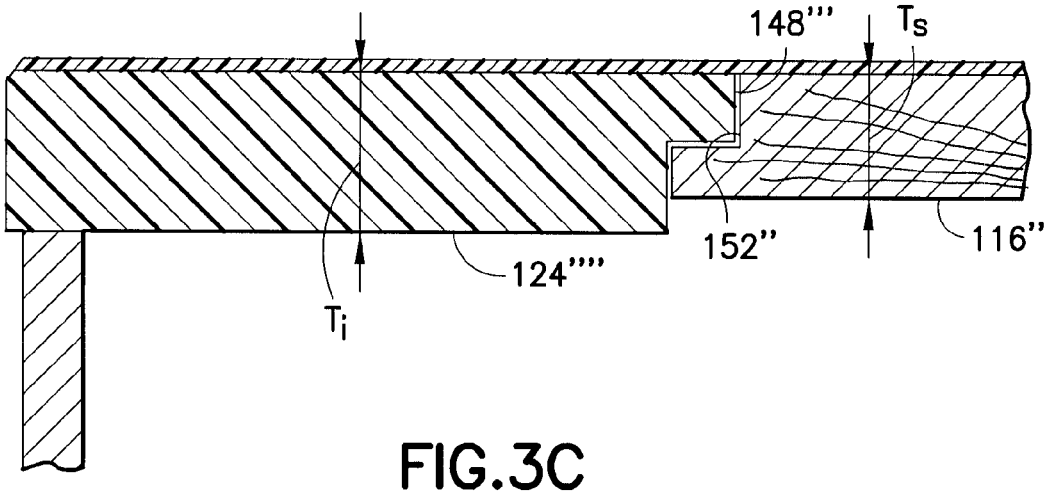

Of course, sink support insert 124 may be engaged within insert opening 128 of support structure 116 in many other ways, some of which are illustrated in FIGS. 3A-3C. FIG. 3A shows sink support insert 124" as having the same thickness $T_i$ as thickness $T_s$ of support structure 116'. Peripheries 148', 152' of sink support insert 124" and support structure 116', respectively, are formed at 90° relative to upper surfaces 156', 160' of these members. In this case, sink support insert 124" may be supported by support structure 116' using clips 164 and/or adhesive 168 between peripheries 148', 152'. This configuration has the benefit that peripheries 148', 152' need not meet as precisely as required in the forward bevel configuration of FIGS. 1A and 1B. Reasonable gaps between peripheries 148', 152' can typically be filled with a suitable filler or readily spanned by surfacing 120'.

FIG. 3B shows another complementary configuration for peripheries 148", 152" when thickness $T_i$ of sink support insert 124'" is less than thickness $T_s$ of support structure 116". Periphery 152" has a 90° rabbet and periphery 148" is simply a 90° edge. Like the configuration of FIG. 3A, the configuration of FIG. 3B has the benefit that peripheries 148", 152" need not meet as precisely as required in the forward bevel configuration of FIGS. 1A and 1B. Reasonable gaps between peripheries 148", 152" can typically be filled with a suitable filler or readily spanned by surfacing 120'.

FIG. 3C shows support structure 116" having the same rabbetted periphery 152" of FIG. 3B. However, in this example, instead of the thickness $T_i$ of sink support insert 124"" being less than the thickness of support structure 116", the thickness $T_i$ of the insert is greater than the thickness $T_s$ of the support structure. Consequently, periphery 148'" of sink support insert 124"" may be rabbetted in a manner complementary to periphery 152".

Although the invention has been described and illustrated with respect to an exemplary embodiment thereof, it should be understood by those skilled in the art that the foregoing and various other changes, omissions and additions may be made therein and thereto, without parting from the spirit and scope of the present invention.

What is claimed is:

1. A sink-support assembly for installing a sink having a weight into a countertop for providing a finished sink installation that includes a faucet, the sink-support assembly comprising:

a sheet substrate made of a non-waterproof material, said sheet substrate comprising:

a supportive inner periphery defining an insert opening; and a planar upper surface designed and configured to adhesively receive countertop surfacing in the finished sink installation; and a sink-support insert secured to said sheet substrate and designed and configured to carry the weight of the sink to said sheet substrate in the finished sink installation, said sink support insert comprising a plate made of a waterproof material, said plate:

having a planar upper surface designed and configured for adhesively receiving countertop surfacing when the sink-support insert is in the finished sink installation;

having a lower surface;

having an outer periphery conformally engaging said supportive inner periphery of said sheet substrate so that in the finished sink installation:

said supportive inner periphery vertically supports said sink-support insert and the sink and the faucet attached thereto in the finished sink installation; and said planar upper surface of said plate is flush with the planar upper surface of said sheet substrate;

wherein said plate is sized and configured to receive a sink opening spaced from said outer periphery of said plate so as to define a sink mounting region and a spacing between said sink mounting region and said outer periphery of said plate that is:

selected to provide a waterproof faucet mounting region sized and configured to receive a faucet aperture for receiving therethrough a portion of the faucet in the finished sink installation; and selected to decrease, in the finished sink installation, a likelihood of any water that infiltrates between the sink and said sink mounting region migrating to the sheet substrate along said lower surface of said plate.

2. A sink-support assembly according to claim 1, wherein said supportive inner periphery on said sheet substrate includes a first forward bevel and said outer periphery of said plate has a second forward bevel.

3. A sink-support assembly according to claim 2, wherein said first forward bevel is continuous around said supportive inner periphery on said sheet substrate and said second forward bevel is continuous around said outer periphery of said plate.

4. A sink-support assembly according to claim 1, wherein said supportive inner periphery on said sheet substrate includes a rabbet formed in said planar upper surface of said sheet substrate so as to form a supportive shoulder.

5. A sink-support assembly according to claim 4, wherein said rabbet is continuous around the supportive inner periphery.

6. A sink-support assembly according to claim 1, wherein said plate further includes said sink opening.

7. A sink-support assembly according to claim 6, wherein said plate further includes the faucet aperture.

8. A sink-support assembly according to claim 1, wherein said spacing between said sink mounting region and said outer periphery of said plate is further selected to provide a waterproof additional sink-appurtenance mounting region designed and configured to receive an additional sink-appurtenance aperture for receiving therethrough a portion of an additional sink appurtenance in the finished sink installation.

9. A sink-support assembly according to claim 1, wherein said outer periphery of said plate is adhesively bonded to said supportive inner periphery of said sheet substrate.

10. A sink-support assembly according to claim 1, wherein said sheet substrate comprises particle board.

11. A method of fabricating a sink-support assembly for installing into a finished sink installation comprising a sink and countertop surfacing, wherein the sink has a weight, the method comprising:

providing a sheet of waterproof material having a first planar upper surface for receiving the countertop surfacing in the finished sink installation;

fabricating a sink-support insert from the sheet of waterproof material, wherein said fabricating the sink-support insert includes:

sizing the sink-support insert to accommodate a sink opening that defines a sink mounting region and a spacing between the sink mounting region and an outer periphery of the sink-support insert that is:

selected to provide a waterproof faucet mounting region sized and configured to receive a faucet aperture for receiving therethrough a portion of the faucet in the finished sink installation; and selected to decrease, in the finished sink installation, a likelihood of any water that infiltrates between the sink and the sink mounting region migrating to the outer periphery along said lower surface of said plate;

providing a sheet of non-waterproof material having a second planar upper surface for receiving the countertop surfacing in the finished sink installation;

fabricating a sheet substrate from the sheet of non-waterproof material, wherein said fabricating the sheet substrate includes:

forming an insert opening in the sheet substrate; and providing the sheet substrate with a supportive inner periphery at the insert opening, wherein the supportive inner periphery is configured to:

provide vertical support against gravity to the sink support insert for transferring the weight of the sink to the sheet substrate in the finished sink installation; and engage the outer periphery of the sink-support insert so that the first planar upper surface is flush with the second planar upper surface; and securing the sink support insert to the sheet substrate in the insert opening so that the first planar upper surface is flush with the second planar upper surface.

12. A method according to claim 11, further comprising providing the outer periphery of the sink-support insert and the supportive inner periphery of the sheet substrate with corresponding forward bevels.

13. A method according to claim 12, wherein said providing the outer periphery of the sink-support insert and the supportive inner periphery of the sheet substrate with corresponding forward bevels includes providing the forward bevels so that they are continuous around the outer periphery and the supportive inner periphery.

14. A method according to claim 11, further comprising providing the supportive inner periphery of the sheet substrate with a rabbet formed in the second planar upper surface so as to form a supportive shoulder.

15. A method according to claim 14, wherein said providing the supportive inner periphery of the sheet substrate with a rabbet includes providing a rabbet that is continuous around the supportive inner periphery.

16. A method according to claim 11, further comprising forming the sink opening in the plate.

17. A method according to claim 16, further comprising forming a faucet aperture in the waterproof faucet mounting region.

18. A method according to claim 11, wherein the spacing is further selected to provide a waterproof additional sink-appurtenance mounting region designed and configured to receive an additional sink-appurtenance aperture for receiving therethrough a portion of an additional sink appurtenance in the finished sink installation.

19. A method according to claim 11, wherein said securing the sink support insert to the sheet substrate includes adhesively bonding the sink support insert to the sheet substrate.

20. A method according to claim 11, wherein said providing a sheet of non-waterproof material includes providing a sheet of non-waterproof particle board.

* * * * *